US011437175B2

(12) United States Patent
Wu et al.

(10) Patent No.: US 11,437,175 B2
(45) Date of Patent: Sep. 6, 2022

(54) MAGNETIC UNIT

(71) Applicant: Delta Electronics (Shanghai) CO., LTD, Shanghai (CN)

(72) Inventors: Rui Wu, Shanghai (CN); Yiqing Ye, Shanghai (CN); Yuan Zhou, Shanghai (CN)

(73) Assignee: Delta Electronics (Shanghai) CO., LTD, Shanghai (CN)

( * ) Notice: Subject to any disclaimer, the term of this patent is extended or adjusted under 35 U.S.C. 154(b) by 463 days.

(21) Appl. No.: 16/707,041

(22) Filed: Dec. 9, 2019

(65) Prior Publication Data

US 2020/0211756 A1 Jul. 2, 2020

(30) Foreign Application Priority Data

Dec. 29, 2018 (CN) ..... 201811644701.3

(51) Int. Cl.
*H01F 27/24* (2006.01)
*H01F 27/28* (2006.01)

(52) U.S. Cl.
CPC ..... *H01F 27/24* (2013.01); *H01F 27/28* (2013.01); *H01F 27/2804* (2013.01)

(58) Field of Classification Search
CPC ..... H01F 27/24; H01F 27/28; H01F 27/2804; H01F 2027/2809; H01F 2027/2819; H01F 27/306
See application file for complete search history.

(56) References Cited

U.S. PATENT DOCUMENTS 7,965,166 B2 6/2011 Okawa et al.
9,472,333 B2 * 10/2016 Yonezawa ..... H01F 27/2804
2010/0079232 A1 * 4/2010 Okawa ..... H01F 27/2804 336/200
2017/0213637 A1 * 7/2017 Vanukuru ..... H01F 17/0013
(Continued)

FOREIGN PATENT DOCUMENTS

CN 85101788 A 1/1987
CN 103608878 A 2/2014
CN 104465044 A 3/2015
(Continued)

OTHER PUBLICATIONS

Notice of Allowance dated Apr. 19, 2021 from CN patent application No. 201811644701.3.
The CN1OA issued Oct. 28, 2020 by the CNIPA.

*Primary Examiner* — Lincoln D Donovan
*Assistant Examiner* — Alex W Lam
(74) *Attorney, Agent, or Firm* — Qinghong Xu

(57) ABSTRACT

The present disclosure relates to the field of power electronic technology, provides a magnetic unit, including: a magnetic core and a winding, the magnetic core includes Q magnetic legs arranged in a row, where Q is a natural number and Q≥2, and the winding includes a first winding and a second winding, where the first winding is magnetically coupled with the second winding, and the first winding is wound around the Q magnetic legs while the second winding is wound around the Q magnetic legs. The first winding between any two adjacent magnetic legs is generally symmetrically disposed at both sides of the symmetric plane between the any two adjacent magnetic legs, thereby the magnetomotive force (MMF) distribution between any two adjacent magnetic legs is uniform.

19 Claims, 19 Drawing Sheets

(56) References Cited

U.S. PATENT DOCUMENTS

2018/0308625 A1* 10/2018 Hasegawa ..... H01F 27/022

FOREIGN PATENT DOCUMENTS

| | | | |
|---|---|---|---|
| CN | 105163489 | A | 12/2015 |
| CN | 106448998 | A | 2/2017 |
| CN | 107146694 | A | 9/2017 |
| EP | 3267444 | A1 | 1/2018 |
| TW | 385454 | B | 3/2000 |

* cited by examiner

MAGNETIC UNIT

CROSS REFERENCE

This application is based upon and claims priority to Chinese Patent Application No. 201811644701.3, filed on Dec. 29, 2018, the entire contents thereof are incorporated herein by reference.

TECHNICAL FIELD

This disclosure relates to the field of power electronic technology, and more particularly, to a magnetic unit.

BACKGROUND

With the improvement of human requirements for smart living, the demand for data processing in society is growing. The global energy consumption of data processing amounts to hundreds of billions or even trillions of kilowatt hours per year. And a large data center may cover tens of thousands of square meters. Therefore, high efficiency and high power density are key indicators of the healthy development of this industry.

The key unit of the data center is the server. The main board of the server is generally composed of central processing unit (CPU), Chipsets, memory or other data processing chips as well as their power supply and necessary peripheral components. As the processing capacity of the server per unit volume increases, it means that the number and integration of these processing chips are also increasing, resulting in an increase in space occupancy and power consumption. Therefore, the power supply for providing power for these chips—also known as main board power supply because it is on the same main board as the data processing chip—is expected to have higher efficiency, higher power density and smaller size to support the entire server and even the entire data center reducing energy consumption and floor space. In order to meet the demand of high power density, the switching frequency of the power supply is also getting higher and higher. The switching frequency of a low voltage and high current power supply in the industry is 1 MHz in general.

The windings of most of the high-frequency and high-power density magnetic components are formed by PCB, while holes are reserved for mounting the magnetic material, which is often referred to as the magnetic core. As shown in FIG. 1A, the magnetic component includes a winding 1, a winding 2 and a magnetic core, where the winding 1 and winding 2 are formed by a copper foil on the PCB, and since the PCB is made by laminating a plurality layers of copper foil and insulation layers, the structures of the winding I and winding 2 are multi-layer copper foil, and FIG. 1B is an upper plan view of FIG. 1A.

For ease of explanation, FIG. 1B is symmetrical, and as shown in FIG. 1B, theme are two symmetrical lines, which are a center line 1 and a center line 2 respectively.

Two main aspects are considered for high efficiency and low loss of windings: the first is the direct current (DC) resistance Rdc of the winding, and the second is the AC loss coefficient Kac of the winding, and the winding loss may be expressed as follows:

$$Pwinding=Irms^2\times Rdc\times Kac$$

where Irms is the root mean square of the current through the winding, which is determined by the operating state of the circuit. In the same working state, the smaller the Rdc and Kac are, the lower the winding loss is.

For PCB or copper foil windings, the key to reduce Rdc is to increase the utilization of copper foil under the same condition of area and thickness. As shown in FIG. 2, there is a typical PCB winding, it is showed that the winding gap, except the hole opened for magnetic legs in the PCB, affects the utilization of copper. The larger and the more the winding gap are, the lower the copper foil utilization of the winding is, and the higher the Rdc of the winding is, the Effeater the loss of the winding is. In general, the winding gap is determined by the process, and is related to the thickness of the PCB copper foil and the manufacturing process of the manufacturer. Therefore, the winding gap W2 has a minimum value and will not keep getting smaller as the total width W1 of the winding and the gap becomes smaller. As a result, in the case that W1 is close to W2, the number of gaps will significantly affect the copper utilization of winding. For a practical example, if W1=2 mm, the minimum of W2 is 0.2 mm, with two winding gaps, then the copper utilization rate is about 80%; if W1=1 mm, and W2 and the gap number remain unchanged, then the copper utilization rate is reduced to 60%. Reducing the number of gaps becomes the most effective option for improving copper utilization. If there is no gap, the number of turns becomes 1 turn per layer, and the copper utilization rate is 100%. In this case, more layers are required for implementing the required number of turns, which results in an obvious problem of the increase in cost and the increase in PCB thickness. In practice, the number of layers of the PCB is limited, thereby the design of 1 turn per layer cannot be applied in every situation.

Another key parameter affecting the winding loss is Kac, which is determined by the structure of the winding, the switching frequency, and the thickness of the copper foil. In the case where the switching frequency and the thickness of the copper foil are fixed, the value of the Kac is determined by the winding structure, which may be determined according to a typical principle of magnetomotive force (MMF). In general, the more uniform the MMF distribution is, the smaller the Kac value is. An example of an MMF diagram of a structure with even number of turns between magnetic legs is shown in FIG. 3A. On the left side of FIG. 3A, there is the cross-sectional structural view of FIG. 1A drawn along the center line 1 shown in FIG. 1B, where P represents a primary winding, and S1 and S2 are secondary windings. On the right side of FIG. 3A is the MMF diagram of the windings between the two magnetic legs. From the point of view of MMF, the maximum point of the MMF distribution is the same as the absolute value of the minimum point, so the distribution is relatively uniform, and no significant MMF value is too large or too small. In FIG. 3B, however, there are an odd number of turns of wiring layers between the magnetic legs, and the value of one point shown in the MMF distribution diagram is obviously large, consequently the Kac is large in the structure shown in FIG. 3B. The simulation of the actual structure shows that in the case of 1 MHz and copper thickness of 3 oz, the Kac of the structure in FIG. 3B is about 25% larger than that in FIG. 3A. Therefore, the more uniform the MMF distribution is, the smaller the Kac is, and whether the MMF distribution is uniform is related to the structure of the winding. The upper and lower windings of FIG. 3A are evenly distributed, so the MMF distribution is uniform, while the upper and lower windings shown in FIG. 3B are not uniform, so the MMF distribution is not uniform. This phenomenon is more obvious when there is a wiring layer provided with an odd number of turns (2n+1 turns) of windings between the magnetic legs.

Therefore, a scheme of structural design of a new magnetic unit is required.

The above information disclosed in the Background section is only for enhancement of understanding of the background of the present disclosure, thus it may include information that does not belong to the prior art known to those skilled in the art.

SUMMARY

The present disclosure provides a magnetic unit for solving one or more problems due to limitations and defects in the related art to a certain extent, Other characteristics and advantages of the present disclosure will be apparent from the following detailed description, or may be partly learned through the practice of the present disclosure.

According to a first aspect of the present disclosure, there is provided a magnetic unit, including: a magnetic core including: Q magnetic legs arranged in a row, where Q is a natural number and $Q \geq 2$; a first winding wound around the Q magnetic legs; and a second winding magnetically coupled with the first winding and wound around the Q magnetic legs;

wherein the first winding includes a first winding section formed on a first layer and a second winding section formed on a second layer; wherein a virtual straight line exists between an $i^{th}$ magnetic leg and an $(i+1)^{th}$ magnetic leg adjacent the magnetic leg among the Q magnetic legs, and the virtual straight line intersects with a projection of the first winding section to form first cross line segments, and the number of the first cross line segments is 2n+1, and the virtual straight line intersects with a projection of the second winding section to form second cross line segments, and the number of the second cross line segments is 2n+1, where $1 \leq i \leq Q-1$ and $n \geq 1$;

wherein the magnetic leg and the $(i+1)^{th}$ magnetic leg have a symmetric plane, and a $(n+1)^{th}$ cross line segment among the (2n+1) first cross line segments intersects with the symmetric plane; $(n+1)^{th}$ cross line segment among the (2n+1) second cross line segments intersects with the symmetric plane.

According to a second aspect of the present disclosure, there is provided a magnetic unit, including a magnetic matrix having magnetic legs arranged with P rows and Q columns, P and Q are natural numbers and $P \geq 2$, $Q \geq 2$; a first winding wound around the P*Q magnetic legs; and a second winding magnetically coupled with the first winding and wound around the P*Q magnetic legs;

wherein the first winding includes a first winding section formed on a first layer and a second winding section formed on a second layer; a first virtual straight line exists between an $i^{th}$ magnetic leg and an $(i+1)^{th}$ magnetic leg adjacent to the magnetic leg among the Q magnetic legs in each row of the P*Q magnetic legs, the first virtual straight line intersects with a projection of the first winding section to form first cross line segments, and the number of the first cross line segments is 2n+1, and the first virtual straight line intersects with a projection of the second winding section to form second cross line segments, and the number of the second cross line segments is 2n+1; a second virtual straight line exists between a $j^{th}$ magnetic leg and a $(j+1)^{th}$ magnetic leg adjacent to the $j^{th}$ magnetic leg among the P magnetic legs in each column, the second virtual straight line intersects with a projection of the first winding section to form third cross line segments, and the number of the third cross line segments is 2n+1, and the second virtual straight line intersects with a projection of the second winding section to form fourth cross line segments, and the number of the fourth cross line segments is 2n+1, where $1 \leq i \leq Q-1$, $1 \leq j \leq P-1$ and $n>1$;

wherein the magnetic leg and the $(i+1)^{th}$ magnetic leg adjacent to the magnetic leg in each row have a first symmetric plane, and a $(n+1)^{th}$ cross line segment among the (2n+1) first cross line segments intersects with the first symmetric plane; a $(n+1)^{th}$ cross line segment among the (2n+1) second cross line segments intersects with the first symmetric plane; the $j^{th}$ magnetic leg and the $(j+1)^{th}$ magnetic leg adjacent to the $j^{th}$ magnetic leg in each column have a second symmetric plane, and a $(n+1)^{th}$ cross line segment among the (2n+1) third cross line segments intersects with the second symmetric plane; and a $(n+1)^{th}$ cross line segment among the (2n+1) fourth cross line segments intersects with the second symmetric plane.

It is to be understood that both the foregoing general description and the following detailed description are exemplary and explanatory only and are not restrictive of the invention, as claimed.

BRIEF DESCRIPTION OF THE DRAWINGS

Through detailed descriptions of the example embodiments with reference to the drawings, the above and other purposes, properties and advantages of the present disclosure will become more apparent.

DETAILED DESCRIPTION

Figure 1A:
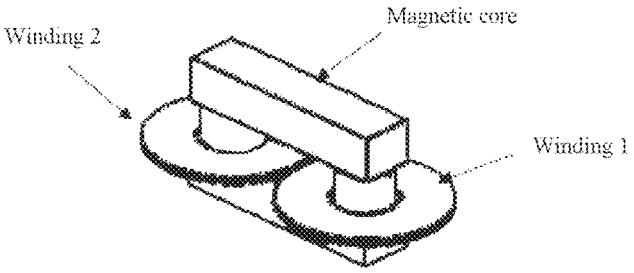
FIG. 1A is a perspective view of a magnetic component using a PCB winding.
Figure 1B:
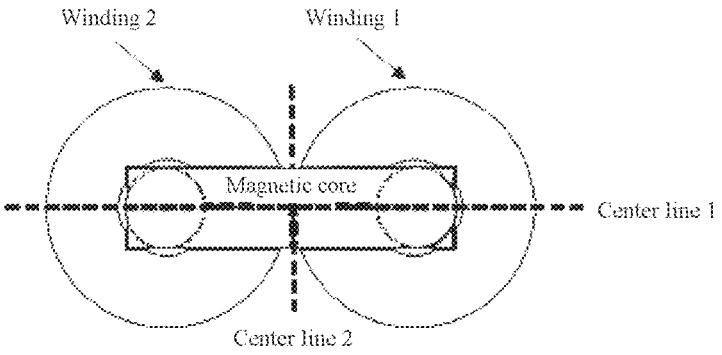
FIG. 1B is a plan view of a magnetic component using a PCB winding.
Figure 2:
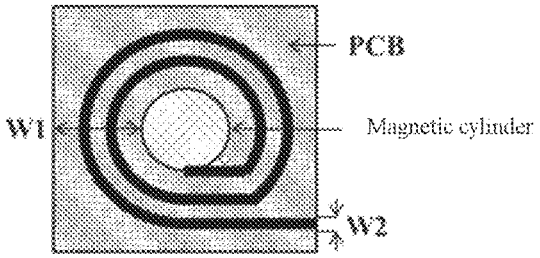
FIG. 2 is a schematic diagram of a typical PCB winding.

Example embodiments will now be described more fully with reference to the drawings. However, the example embodiments may be embodied in a variety of forms and should not be explained as being limited to the embodiments set forth herein, but are provided to make the present disclosure thorough and complete and fully transfer the concept of the example embodiments to those skilled in the art. The same reference numerals in the drawings denote the same or similar parts, and thereby repeated description thereof will be omitted.

Furthermore, the described features, structures, or characteristics may be combined in any suitable way in one or more embodiments. In the following description, numerous specific details are set forth for full understanding of the present disclosure. However, those skilled in the art will understand that the technical solutions of the present disclosure may be practiced without one or more of the specific details, or other methods, components, devices, steps, etc. may be employed. In other instances, well-known methods, devices, implementations, or operations are not shown or described in detail to avoid obscuring various aspects of the present disclosure.

The block diagrams shown in the figures are merely functional entities and do not necessarily have to correspond to physically separate entities. That is, these functional entities may be implemented by software, or implemented by one or more hardware modules or integrated circuits, or implemented in different networks and/or processor devices and/or microcontroller devices.

The flowcharts shown in the drawings are merely illustrative, and not all of the contents and operations/steps are necessarily included, or are not necessarily performed in the order described. For example, some operations/steps may be decomposed, and some operations/steps may be combined or partially combined, thus, the actual execution order may be changed according to actual situation.

It should be understood that although the terms first, second, third, etc. may be used herein to describe various components, these components are not limited by these terms. These terms are used to distinguish one component from another. Therefore, the first component discussed below could be termed the second component without deviating from the teachings of the concept of the present disclosure. The term "and/or" as used herein includes any and all combinations of one or more of the associated listed items.

Those skilled in the art can understand that the drawings are only schematic diagrams of example embodiments, and the modules or processes in the drawings are not necessarily required to implement the present disclosure, and thereby cannot be used to limit the scope of protection of the present disclosure.

The purpose of the present disclosure is to provide a magnetic unit, including: a magnetic core, including Q magnetic legs arranged in a row, where Q is a natural number and Q≥2; a first winding wound around the Q magnetic legs; and a second winding magnetically coupled with the first winding and wound around the Q magnetic legs. The first winding between any two adjacent magnetic legs is generally symmetrically disposed at both sides of the symmetric plane between the two adjacent magnetic legs, in this way, the distribution of the magnetomotive force (MMF) is uniform between any two adjacent magnetic legs. Therefore, the magnetic unit of the present disclosure has a very low AC loss as well as a very high utilization of copper (which means having a very small DC resistance Rdc), accordingly the total loss of the magnetic unit is very low.

Figure 4:
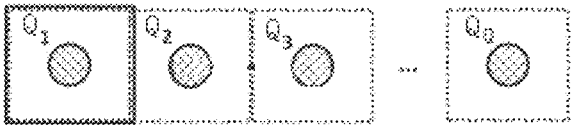
FIG. 4 is a schematic diagram of a magnetic unit according to an example embodiment of the present disclosure.
Figure 5A:
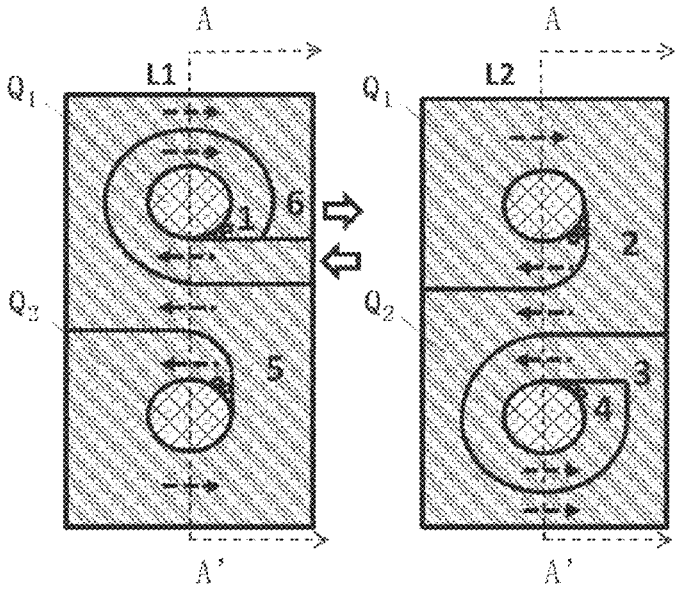
FIG. 5A is a top view of a magnetic unit with two magnetic legs according to the present disclosure.
Figure 5B:
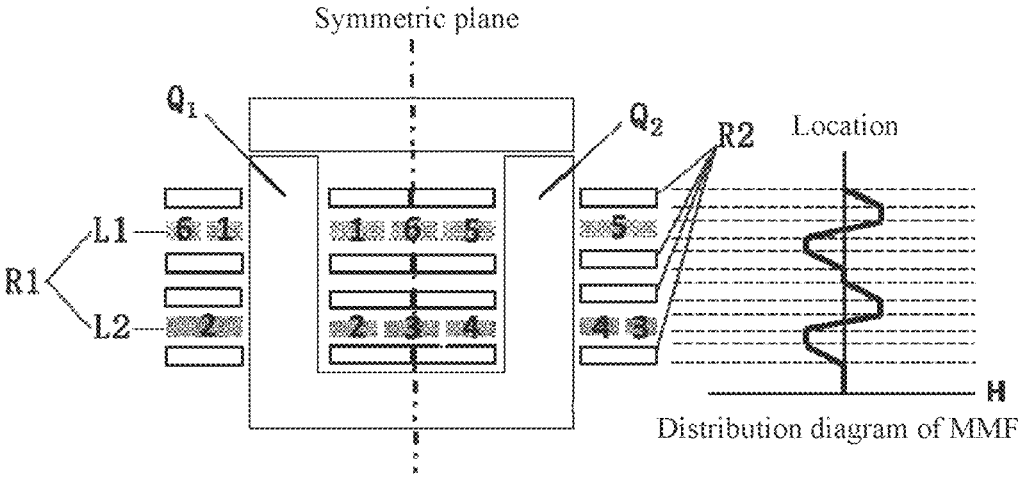
FIG. 5B is a sectional view along an AA' section in FIG. 5A and a schematic diagram of the magnetomotive force distribution.
Figure 6A:
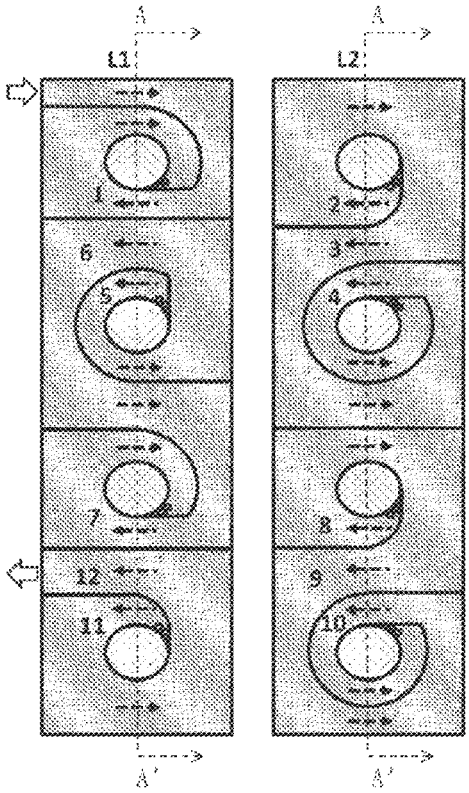
FIG. 6A is a top view of a magnetic unit with four magnetic legs according to the present disclosure.
Figure 6B:
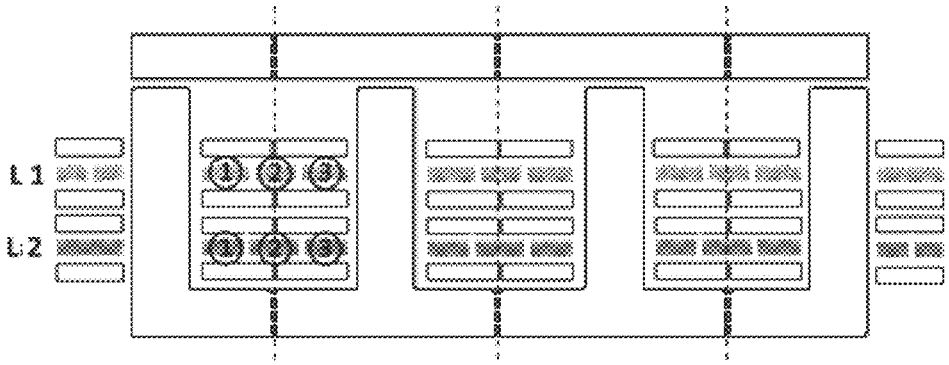
FIG. 6B is a sectional view along an AA' direction in FIG. 6A and a schematic diagram of the magnetomotive force distribution.
Figure 7:
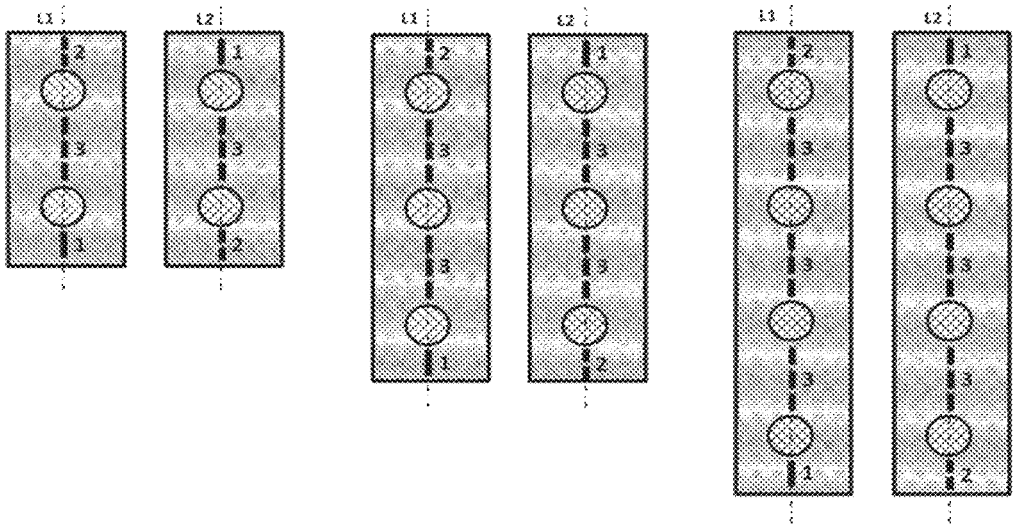
FIG. 7 is a schematic diagram of a distribution of the cross line segments of a magnetic unit with two, three or four magnetic legs when n equals to 1.
Figure 8A:
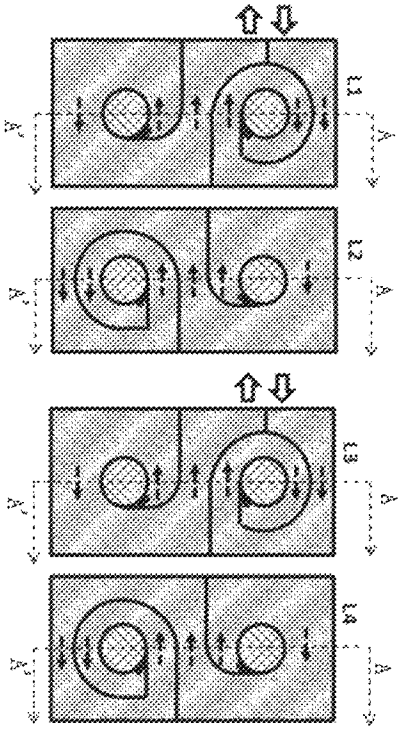
FIG. 8A is a top view of a magnetic unit with two first windings.
Figure 8B:
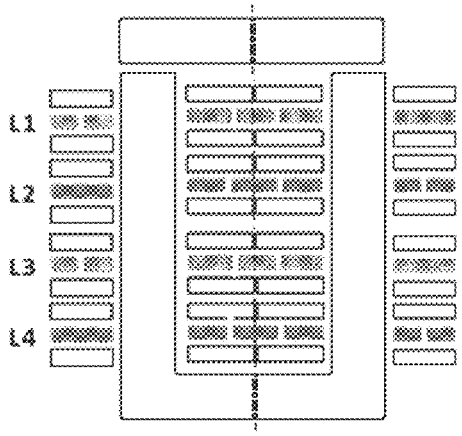
FIG. 8B is a sectional view along an AA' direction in FIG. 8A.

A magnetic unit of the present disclosure will be described in detail below with reference to FIGS. 4-8B, where FIG. 4 is a schematic diagram of a magnetic unit according to an example embodiment of the present disclosure; FIG. 5A is a top view of a magnetic unit with two magnetic legs according to the present disclosure, the top view being given only by taking two layers of L1 and L2 as an example; FIG. 5B is a sectional view along an AA' direction in FIG. 5A and a schematic diagram of the magnetomotive force distribution; FIG. 6A is a top view of a magnetic unit with four magnetic legs according to the present disclosure; FIG. 6B is a sectional view along an AA' direction in FIG. 6A and a schematic diagram of the magnetomotive force distribution; FIG. 7 is a schematic diagram of a distribution of the cross line segments of a magnetic unit with two, three or four magnetic legs when n equals to 1; FIG. 8A is a top view of a magnetic unit with two first windings; and FIG. 8B is a sectional view along an AA' direction in FIG. 8A, The magnetic legs may be connected through an upper cover and a lower cover of a magnetic core, but the present disclosure is not limited thereto.

As shown in FIGS. 4-8B, the magnetic unit includes a magnetic core and a winding; the winding includes a first winding R1 and a second winding R2, and the first winding R1 is magnetically coupled with the second winding R2, where the first winding R1 is marked with specific numbers of turns, and the second winding R2 is not marked with specific numbers of turns. The second winding R2 may also be implemented by distributing in one layer or two layers, and the present disclosure is not limited thereto. The magnetic core includes Q magnetic legs arranged front 1 to Q in a row, where Q is a natural number and Q≥2. The first winding is wound around all the Q magnetic legs and the second winding is wound around all the Q magnetic legs. The first winding R1 includes a first winding section formed on a first layer L1 and a second winding section formed on a second layer L2. The magnetic core may include other magnetic legs besides the Q magnetic legs. A virtual straight line (the AA' line shown in FIG. 5A) exists between an $i^{th}$ magnetic leg and an $(i+1)^{th}$ magnetic leg adjacent to the $i^{th}$ magnetic leg among the Q magnetic legs, and the virtual straight line intersects with a projection of the first winding section to form first cross line segments, the number of the first cross line segments is 2n+1 (as shown in FIG. 7, FIG. 7 is a schematic diagram of a distribution of the cross line segments of a magnetic unit with two, three or four magnetic legs when n equals to the number of the first cross line segments formed between the two adjacent magnetic legs is 3, which is an odd number), the virtual straight line intersects with a projection of the second winding section to form second cross line segments, the number of the second cross line segments is 2n+1, where 1≤i≤Q−1 and n≥1. In fact, 2n+1 is the number of turns of the winding coils between any two adjacent magnetic legs, and in the following description (and corresponding drawings), n=1 (the number of turns of the winding coil between any two adjacent magnetic legs is 3) is taken as an example for explanation, but the present disclosure is not limited thereto. The magnetic leg and the $(i+1)^{th}$ magnetic leg have a symmetric plane, and a $(n+1)^{th}$ cross line segment among the (2n+1) first cross line segments intersects with the symmetric plane, as shown in FIG. 5B, the second cross line segment (that is, the cross line segment on the winging coil with the number of turns labeled as 6) among the 3 first cross line segments of the first winding section between the first magnetic leg $Q_1$ and the second magnetic leg $Q_2$, intersects with the symmetric plane; and a $(n+1)^{th}$ cross line segment among the (2n+1) second cross line segments intersects with the symmetric plane, as shown in FIG. 5B, the second cross line segment (that is, the cross line segment on the winging coil with the number of turns labeled as 3) among the 3 second cross line segments of the second winding section between the first magnetic leg $Q_1$ and the second magnetic leg $Q_2$ intersects with the symmetric plane. With such distribution structure, the odd-numbered turns of windings between adjacent two magnetic legs tend to be evenly distributed, which is beneficial to the MMF distribution. Any two adjacent magnetic legs of the Q magnetic legs may form a virtual straight line, a plurality of virtual straight lines formed by different magnetic legs may not coincide, and it only needs to check the winding distribution between the corresponding two magnetic legs.

Figure 3A:
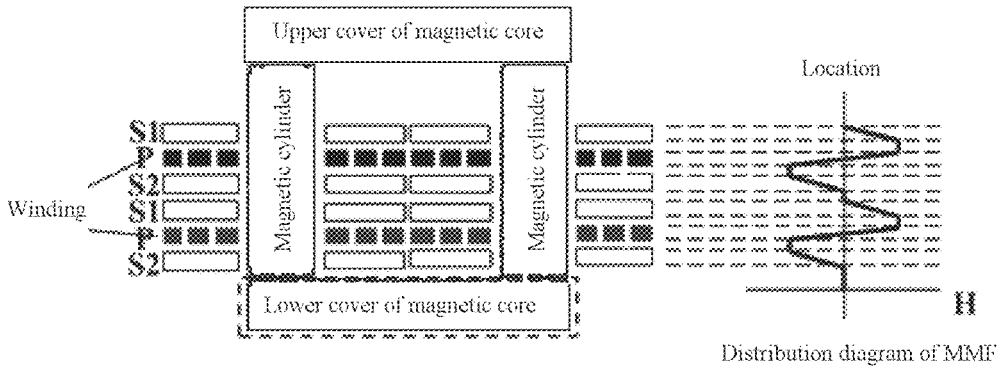
FIG. 3A is a schematic diagram of an existing magnetic unit and its magnetomotive force distribution.
Figure 3B:
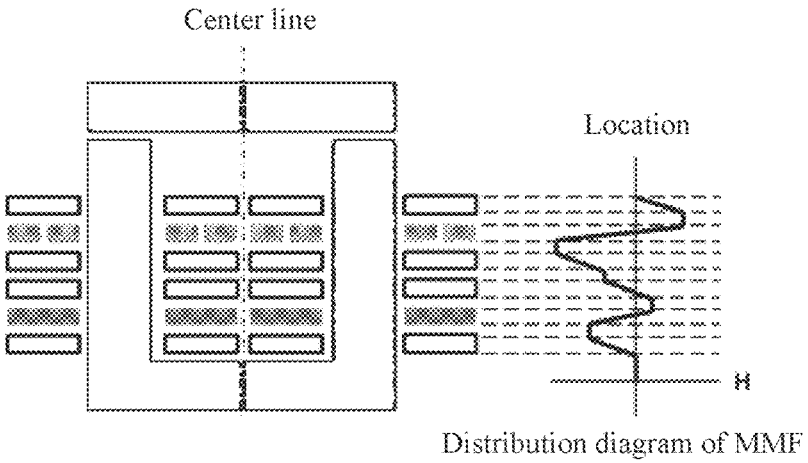
FIG. 3B is a schematic diagram of another existing magnetic unit and its magnetomotive force distribution.

Taking the magnetic unit with two magnetic legs as shown in FIG. 5A and FIG. 5B as an example, FIG. 5A is a top view of a magnetic unit. To magnetic legs according to the present disclosure, and FIG. 5B is a sectional view along an AA' direction in FIG. 5A and a schematic diagram of the magnetomotive force distribution, as can be seen in the drawings, 6 turns of winding coil labeled as 1 to 6 are formed by the first winding R1, and the parts between the two magnetic legs of the 6 turns of winding coil are generally symmetrically disposed at both sides of the symmetric plane, as a result, the distribution of the magnetomotive force (MMF) is uniform between the two magnetic legs (if the parts of the 6 turns of winding coil between the two magnetic legs are symmetrically disposed at both sides of the symmetric plane, the distribution of the magnetomotive force (MMF) between the two magnetic legs is the most uniform). The 6 turns of winding coil are implemented by two layers together, 3 (an odd number) turns of windings need to be formed for each layer, and the 6 turns of winding coil include the first winding sections 1, 5 and 6 on the layer L1 and the second winding section 2, 3 and 4 on the second layer L2, where there are odd number of turns on each layer between the adjacent magnetic legs (which is also reflected as odd number of the cross line segments), therefore needing to be distributed evenly. As the magnetomotive force (MMF) distribution shown in FIG. 5B, since the more uniform the MMF distribution is, the smaller the AC loss coefficient Kac is, the magnetic unit of the present disclosure has a very low AC loss; and in the matter of the utilization of copper, the gaps between the winding coils of the magnetic unit of the present disclosure is also less (compared to the case where there are 5 gaps between adjacent magnetic legs on each layer in the related art shown in FIG. 3A, as shown in FIGS. 5A-5B, there are only 2 gaps between adjacent magnetic legs on each layer with the same number of turns), consequently the magnetic unit of the present disclosure has a higher utilization of copper. That is, the magnetic unit of the present disclosure has a very low AC loss coefficient Kac as well as a very high utilization of copper (which means a very small DC resistance Rdc), accordingly the total conduction loss of the magnetic unit is very low.

Since the region with the property of uniform magnetomotive force (MMF) distribution is the region between the two magnetic legs, and other regions do not have such property, an area of the region with the property of uniform magnetomotive force (MMF) distribution formed by the two magnetic legs is approximately ¼ of the overall area. If there are more magnetic legs to be expanded, larger area of region with uniform MMF distribution may be obtained. For the magnetic unit with four magnetic legs as shown in FIGS. 6A-6B, the first winding R1 includes 12 turns of winding coil labeled as 1 to 12, the parts of the 12 turns of winding coil between the two magnetic legs are generally symmetrically disposed, and 3 (an odd number) turns of winding are required to be formed on any layer between two adjacent magnetic legs. The second cross line segment among the 3 cross line segments is designed to intersect with the symmetric plane between the two corresponding adjacent magnetic legs (as shown by the dotted line in FIG. 6B), in this way, better MMF distribution in the middle of the magnetic leg can be achieved. Since the area ratio of the parts between the magnetic legs on the condition of 4 magnetic legs increases, better MMF distribution can be achieved in around 37.5% of the area, which is higher than 25% on the condition of 2 magnetic legs. As the number of the magnetic legs increases, the area with uniform MMF distribution increases.

In FIG. 6B, taking the distribution of the winding coil between the first magnetic leg and the second magnetic leg on the left as an example, there are three cross line segments labeled as ①, ② and ③ on the layers L1 and L2, of which the middle cross line segment ② is cut into two parts by the symmetric plane of the first magnetic leg and the second magnetic leg on the left (as shown by the dotted line on the left), and the lengths of the two parts are approximately equal, that is, the proportional value of length is approximately 1. However, in other embodiments, it is practicable that the proportional value of length is designed as 0.7, 1.43 or other values, as long as the middle cross line segment ② can be cut by the symmetric plane. The distribution of MMF is more uniform when the proportional value of length is 0.7~1.43.

In addition, as shown in FIG. 6B, the length of the cross line segment ① is less than the cross line segment ②, and the length of the cross line segment ② is greater than the cross line segment ③. When there are more (still an odd number) cross line segments, the design of the length of each cross line segment may be flexible. For example, the length of the middle cross line segment is the greatest, and the cross line segments on the left and right decrease in sequence respectively, at this time, the total resistance of the windings is the smallest; or the lengths of individual cross line segments are close to each other, in this case, it's convenient to design; or it is acceptable for other designs of lengths, such as the design of which the length of the middle cross line segment is the greatest, and the lengths of other cross line segments may be less than or equal to the length of the middle cross line segment. The present disclosure is not limited to any design above.

According to an example embodiment of the present disclosure, the first winding or the second winding is formed by a PCB, a copper foil, a pie winding or any combination thereof. It is practicable that suitable composition/materials of the windings are chosen as required.

According to an example embodiment of the present disclosure, the first winding includes a first winding section formed on a first layer and a second winding section formed on a second layer. The innermost turn of the first winding section wound around the $i^{th}$ magnetic leg and the innermost turn of the second winding section wound around the $i^{th}$ magnetic lee are connected in series, and the innermost turn of the first winding section wound around the $(i+1)^{th}$ magnetic leg and the innermost turn of the second winding section wound around the $(i+1)^{th}$ magnetic leg are connected in series. Taking the magnetic unit with two magnetic legs shown in FIGS. 5A-B as an example, the innermost turn 1 of the first winding section wound around the first magnetic leg $Q_1$ on the L1 layer and the innermost turn 2 of the second winding section wound around the $Q_1$ magnetic leg on the L2 layer are connected in series through via a hole, and the innermost turn 5 of the first winding section wound around the magnetic leg $Q_2$ and the innermost turn 4 of the second winding section wound around the $Q_2$ magnetic leg are connected in series through via a hole, so as to form a current flowing path flowing through the coils of the turn labels of 1-6 in an order, where an arrow pointing to the winding indicates a current inflow direction at a certain moment, while an arrow pointing away from the winding indicates a current outflow direction. The specific mode of the series connection may be determined by the composition/materials of the windings in practice, for example, if the windings is formed by PCBs, they may be connected through via holes; and if the windings is formed by copper foils, they may be connected by means of a copper plating, a copper foil folding, a copper pillar and etc. The first winding section and the second winding section may respectively include several segments of windings, which is not limited by the present disclosure.

According to an example embodiment of the present disclosure, a proportional value A between lengths of the $(n+1)^{th}$ cross line segment among the 2n+1 first cross line segments at two sides of the symmetric plane is 0.7~1.43, and a proportional value B between lengths of the $(n+1)^{th}$ cross line segment among the 2n+1 second cross line segments of the second winding section at two sides of the symmetric plane is 0.7~1.43. Through defining the proportional value, a uniform distribution of MMF is more easily achieved when the middle turn of the odd number windings between the adjacent magnetic legs is cut by symmetric plane.

According to an example embodiment of the present disclosure, each of the (2n+1) first cross line segments has the same length, and each of the (2n+1) second cross line segments has the same length. The design of the same length of each cross line segment is easy for manufacture and implementation, and the cross line segments are entirely symmetrically distributed at two sides of the symmetric plane, accordingly the magnetomotive force (MMF) distribution is more uniform between the two adjacent legs, and a smaller AC loss coefficient Kac is obtained. However, the present disclosure is not limited to any means above. It is also practical that each of the (2n+1) first cross line segments has the same length, and each of the (2n+1) second cross line segments has the same or not completely the same length.

According to an example embodiment of the present disclosure, among the (2n+1) first cross line segments, a length of the $(n+1)^{th}$ cross line segment is greater than or equal to a length of any of other 2n cross line segments, and a length of at least one cross line segment of said other 2n cross line segments is less than the $(n+D1)^{t}$ cross line segment, and among the (2n+1) second cross line segments, a length of the $(n+1)^{th}$ cross line segment is greater than or equal to a length of any of other 2n cross line segments, and a length of at least one cross line segment of said other 2n cross line segments is less than the $(n+1)^{th}$ cross line segment.

According to an example embodiment of the present disclosure, lengths of the (2n+1) first cross line segments gradually increase from the first line segment to the $(n+1)^{th}$ line segment, and gradually decrease from the $(n+1)^{th}$ line segment to the $(2n+1)^{th}$ line segment; and lengths of the (2n+1) second cross line segments gradually increase from the first line segment to the $(n+1)^{th}$ line segment, and gradually decrease from the $(n+1)^{th}$ line segment to the $(2n+1)^{th}$ line segment.

According to an example embodiment of the present disclosure, the first winding and the second winding may be used as a primary winding and a secondary winding of a transformer respectively. For example, the first winding is located at the primary side of the transformer, and the second winding is located at the secondary side of the transformer. In some embodiments, the second winding is located at the primary side and the first winding is located at the secondary side.

According to an example embodiment of the present disclosure, the magnetic unit further includes a plurality of the first winding wound around the Q magnetic legs. That is, the number of layers of the windings is expanded (i.e., added in the direction of z), principally used for increasing the area of copper and decreasing Rdc. For example, a magnetic unit with two first windings is shown in FIGS. 8A-8B; there are two first windings on each magnetic leg, four layers—from the first layer L1 to the fourth layer L4—are included, where the first layer L1 and the second layer L2 are connected in series to form one first winding, while the third layer L3 and the fourth layer L4 are connected in series to form another first winding. And similarly, the specific mode of the series connection may be determined by the composition/materials of the windings, for example, if the windings are formed by PCBs, they may be connected through via holes; and if the windings are formed by copper foils, they may be connected by means of a copper plating, a copper foil folding, a copper pillar and etc.

Figure 9:
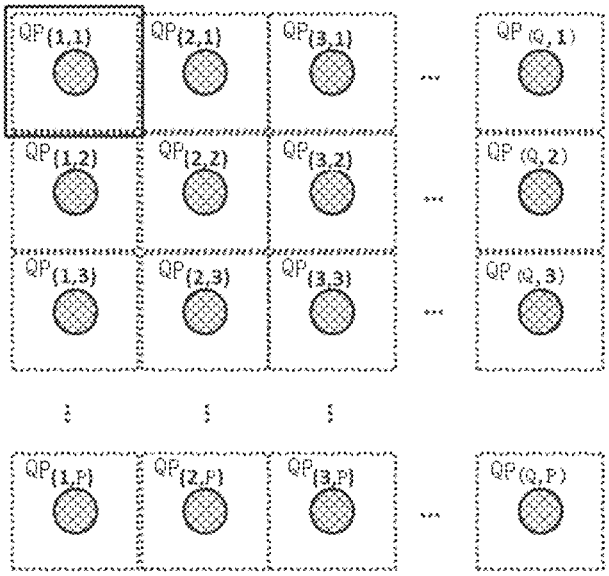
FIG. 9 is a schematic diagram of a magnetic unit according to another example embodiment of the present disclosure.
Figure 10A:
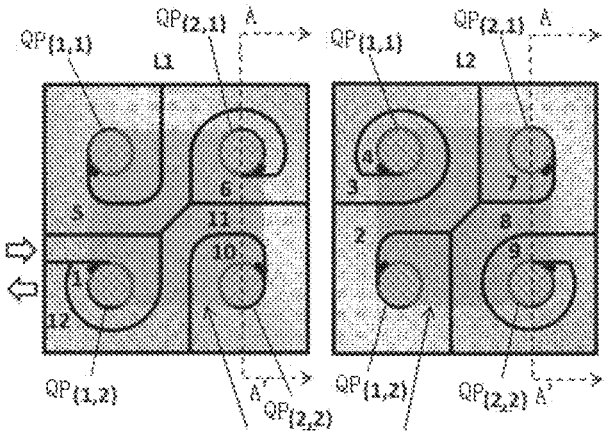
FIG. 10A is a top view of a magnetic unit with 2×2 matrix magnetic legs according to the present disclosure.
Figure 10B:
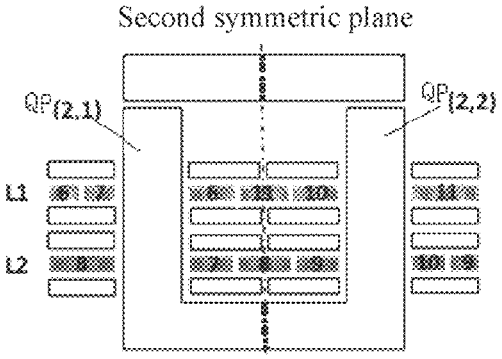
FIG. 10B is a sectional view along an AA' direction in FIG. 10A.
Figure 11:
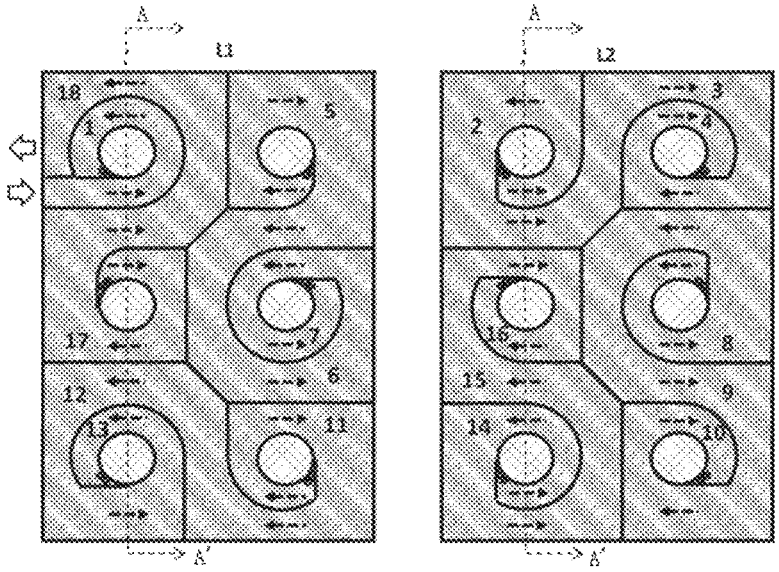
FIG. 11 is a top view of a magnetic unit with 2×3 matrix magnetic legs according to the present disclosure.
Figure 12:
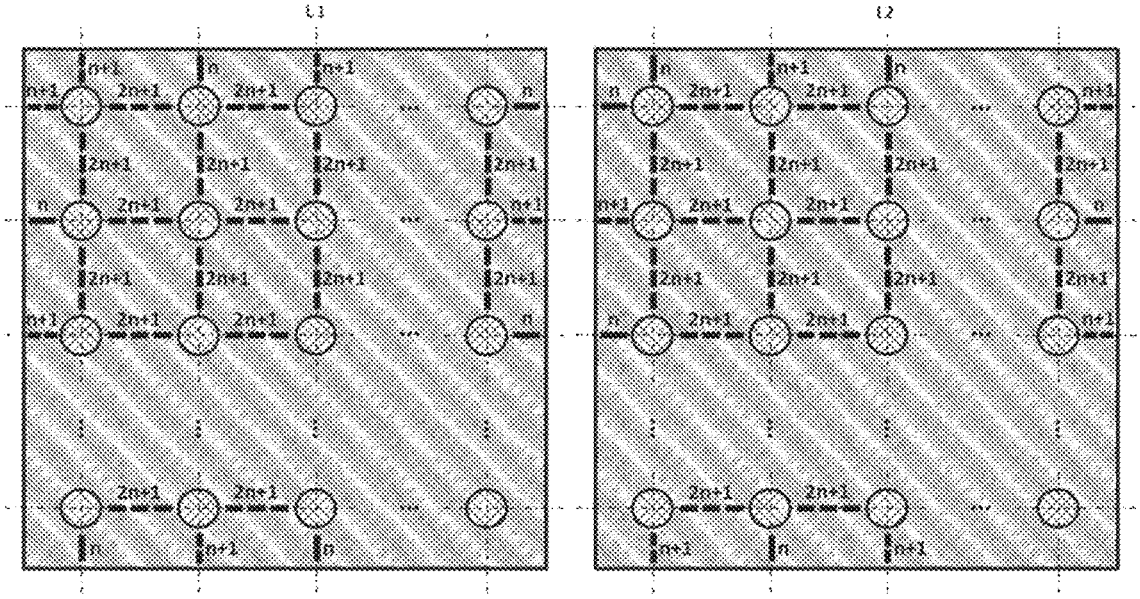
FIG. 12 is a schematic diagram of a distribution of the cross line segments of a magnetic unit according to another example embodiment of the present disclosure.
Figure 13:
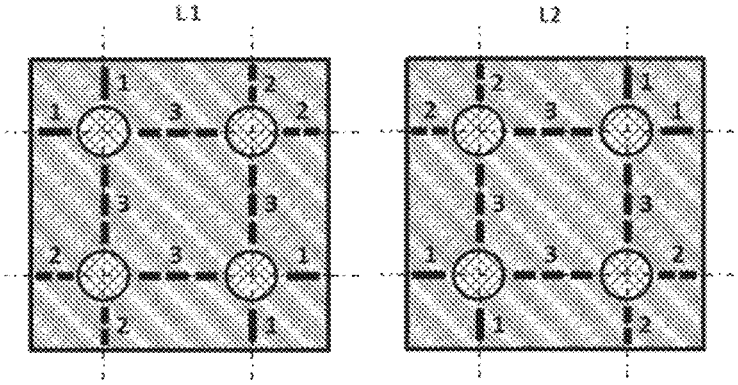
FIG. 13 is a schematic diagram of a distribution of the cross line segments of the magnetic unit shown in FIG. 10A.

As mentioned above, since the region with the property of uniform magnetomotive force (MMF) distribution is the region between the two magnetic legs, and other regions do not have the property, the area of the region between the two magnetic legs with the property of uniform magnetomotive force (MMF) distribution is approximately ¼ of the overall area. If there are more magnetic legs added, larger area with uniform MMF distribution can be obtained. A magnetic unit with expansion of magnetic legs in matrix of the present disclosure will be described in detail below with reference to FIGS. 9-13, where FIG. 9 is a schematic diagram of a magnetic unit according to another example embodiment of the present disclosure; FIG. 10A is a top view of a magnetic unit with 2×2 matrix magnetic legs according to the present disclosure; FIG. 10B is a sectional view along an AA' direction in FIG. 10A; FIG. 11 is a top view of a magnetic unit with 2×3 matrix magnetic legs according to the present disclosure; FIG. 12 is a schematic diagram of a distribution of the cross line segments of a magnetic unit according to another example embodiment of the present disclosure; and FIG. 13 is a schematic diagram of a distribution of the cross line segments of the magnetic unit shown in FIG. 10A.

As shown in FIG. 9 and FIG. 12, the magnetic unit includes a magnetic core and a winding, the winding includes a first winding and a second winding, the first winding is magnetically coupled with the second winding, and the magnetic core eludes a magnetic matrix having magnetic legs which are labeled from $QP_{(1,1)}$ to $QP_{(Q,P)}$ arranged with P rows and Q columns, where P and Q are natural numbers and Q≥2. The first winding is wound around the P*Q magnetic legs and the second winding is wound around the P*Q magnetic legs. The first winding includes a first winding section formed on a first layer L1 and a second winding section formed on a second layer L2. A first virtual straight line may exist between an $i^{th}$ magnetic leg and a $(i+1)^{th}$ magnetic leg adjacent to the $i^{th}$ magnetic leg among the Q magnetic legs in each row, and the first virtual straight line may intersect with a projection of the corresponding first winding section between the $i^{th}$ magnetic leg and the $(i+1)^{th}$ magnetic leg to form first cross line segments, and the number of the first cross line segments is 2n+1, and the first virtual straight line intersects with a projection of the second winding section to form second cross line segments, and the number of the second cross line segments is 2n+1. A second virtual straight line exists between a $j^{th}$ magnetic leg and a $(j+1)^{th}$ magnetic leg adjacent to the $j^{th}$ magnetic leg among P magnetic legs in each column, the second virtual straight line intersects with a projection of the first winding section to form third cross line segments, the number of the third cross line segments is 2n+1, and the second virtual straight line intersects with a projection of the second winding section to form fourth cross line segments, and the number of the fourth cross line segments is 2n+1 (as shown in FIG. 12, FIG. 12 is a schematic diagram of the cross line segments formed by a magnetic unit when n equals to 1 according to an example embodiment of the present disclosure), taking n=1 as an example, i.e., there are 3 cross line segments, under other circumstances, numbers of the cross line segments outside the first magnetic leg and the $Q^{th}$ magnetic leg in each row of the Q magnetic legs may be both n or n+1, and numbers of the cross line segments outside the first magnetic leg and the $P^{th}$ magnetic leg in each column of the P magnetic legs may be both n or n+1 which is not limited to the arrangement shown in FIG. 12. Similarly, with regard to the magnetic unit with magnetic legs arranged in a row as shown in FIG. 7, numbers of the cross line segments outside the magnetic legs at both ends may be both n or n+1, and the number of the cross line segments between adjacent magnetic legs is 2n+1. It is possible for a first (second) virtual straight line to be formed between any two adjacent magnetic legs of a plurality of magnetic legs, and a plurality of virtual straight lines formed by different magnetic leas may not coincide with each other, and they are simply used for checking the distribution of the windings between corresponding two etic legs. In addition, FIG. 13 is a schematic diagram of a distribution of the cross line segments formed by the magnetic unit with 2×2 matrix magnetic legs when n=1, the number of the cross line segments between adjacent magnetic legs is 3, but the distribution of the cross line segments outside the first magnetic leg and the fourth magnetic leg is not limited to the arrangement shown in FIG. 13, and the number of the cross line segments outside each magnetic leg may be 1 (or 2), where $1 \le i \le Q-1$, $1 \le j \le P-1$ and $n \ge 1$ in fact, 2n+1 is namely the number of turns of winding coils provided between any two adjacent magnetic legs, where n=1 (that is, the number of turns of winding coils provided between any two adjacent magnetic legs is 3) is taken as an example for explanation in the following description (and the corresponding drawings), and the present disclosure is not limited thereto. The $i^{th}$ magnetic leg and the $(i+1)^{th}$ magnetic leg adjacent to the $i^{th}$ magnetic leg in each row have a first symmetric plane, and a $(n+1)^{th}$ cross line segment among the (2n+1) first cross line segments of the first winding section between the $i^{th}$ magnetic leg and the $(i+1)^{th}$ magnetic leg intersects with the first symmetric plane; a $(n+1)^{th}$ cross line segment among the (2n+1) second cross line segments of the second winding section between the $i^{th}$ magnetic leg and the $(i+1)^{th}$ magnetic leg intersects with the first symmetric plane; the $j^{th}$ magnetic leg and the $(j+1)^{th}$ magnetic leg adjacent to the $j^{th}$ magnetic leg in each column have a second symmetric plane, and a $(n+1)^{th}$ cross line segment among the (2n+1) third cross line segments of the first winding section between the $j^{th}$ magnetic leg and the $(j+1)^{th}$ magnetic leg intersects with the second symmetric plane; a $(n+1)^{th}$ cross line segment among the (2n+1) fourth cross line segments of the second winding section between the $j^{th}$ magnetic leg and the $(j+1)^{th}$ magnetic leg intersects with the second symmetric plane.

Taking the magnetic unit with 2×2 matrix magnetic legs as shown in FIGS. 10A-10B (besides, FIG. 11 is a top view of a magnetic unit with 2×3 matrix magnetic legs according to the present disclosure) as an example, FIG. 10A is a top view of a magnetic unit with 2×2 matrix magnetic legs according to the present disclosure; FIG. 10B is a section view along an AA' direction in FIG. 10A, from which it can be seen that the first winding R1 includes 12 turns of winding coils labeled as 1 to 12 in order, and the parts between the two magnetic legs of the 12 turns of winding coil are generally symmetrically disposed at both sides of the symmetric plane, as shown in FIG. 10B, the number of the turns (cross line segments) formed on the layers L1 and L2 between the two adjacent magnetic legs $QP_{(2,1)}$ and $QP_{(2,2)}$ is odd, and the middle cross line segments 8 and 11 intersect with the second symmetric plane, as a result, the distribution of the magnetomotive force (MMF) is uniform between the two magnetic legs (if the parts between the two magnetic legs of the 12 turns of winding coil are symmetrically disposed at both sides of the symmetric plane, the distribution of the magnetomotive force (MMF) between the two magnetic legs is the most uniform). Furthermore, since there are more magnetic legs and good MMF distribution can be all achieved between any adjacent magnetic legs, better MMF distribution can be achieved in around 50% of the area, which is greater than the area with better MMF distribution in case of the magnetic unit with 4 magnetic legs (the magnetic legs are arranged in a row) of the example embodiment shown in FIGS. 6A-6B (as mentioned above, it is around 37.5% of the area in which better MMF distribution can be achieved). And the size of the area with uniform MMF distribution increases as the number of the magnetic legs increases.

That is, with the same number of magnetic legs, the magnetic unit with magnetic legs arranged in matrix has a larger area of uniform/better MMF distribution than the magnetic unit with magnetic legs arranged in a row According to an example embodiment of the present disclosure, the first winding or the second winding can be formed by PCB, a copper foil, a pie winding or any combination thereof.

According to an example embodiment of the present disclosure, in the Q magnetic legs in each row, an innermost turn of the first winding section wound around the $i^{th}$ magnetic leg and an innermost turn of the second winding section wound around the $i^{th}$ magnetic leg are connected in series, and an innermost turn of the first winding section wound around the $(i+1)^{th}$ magnetic leg of the Q magnetic legs in each row and an innermost turn of the second winding section wound around the $(i+1)^{th}$ magnetic leg are connected in series; and in the P magnetic legs in each column, an innermost turn of the first winding section wound around the $j^{th}$ magnetic leg of the P magnetic legs in each column and an innermost turn of the second winding section wound around the $j^{th}$ magnetic leg are connected in series, and an innermost turn of the first winding section wound around the $(j+1)^{th}$ magnetic leg and an innermost turn of the second winding section wound around the $(j+1)^{th}$ magnetic leg are connected in series. Taking the magnetic unit with 2×2 matrix magnetic legs as shown in FIGS. 10A-10B as an example, the innermost turn 5 of the first winding section wound around the $QP_{(1,1)}$ magnetic leg and the innermost turn 4 of the second winding section wound around the $QP_{(1,1)}$ magnetic leg are connected in series, and the innermost turn 6 of the first winding section wound around the $QP_{(2,1)}$ magnetic leg and the innermost turn 7 of the second winding section wound around the $QP_{(2,1)}$ magnetic leg are connected in series; and the innermost turn 1 of the first winding section wound around the $QP_{(1,2)}$ magnetic leg and the innermost turn 2 of the second winding section wound around the $QP_{(1,2)}$ magnetic leg are connected in series, and the innermost turn 10 of the first winding section wound around the $QP_{(2,2)}$ magnetic leg and the innermost turn 9 of the second winding section wound around the $QP_{(2,2)}$ magnetic leg are connected in series, forming a current flowing circuit flowing through the coils of turn 1 to turn 12 in sequence, wherein the arrow pointing towards the winding indicates a direction in which current flows in at some moment, while the arrow pointing away from the winding indicates a direction in which the current flows out. The specific mode of the series connection may be determined by the composition/materials of the windings in practice, for example, if the windings are formed by PCBs, they may be connected through via holes; and if the windings are formed by copper foils, they may be connected by means of a copper plating, a copper foil folding, a copper pillar and etc.

According to an example embodiment of the present disclosure, in the Q magnetic legs in each row a proportional value C between lengths of line segments of the $(n+1)^{th}$ first cross line segment at two sides of the first symmetric plane is 0.7~1.43, and a proportional value D between lengths of line segments of the $(n+1)^{th}$ second cross line segment at two sides of the first symmetric plane is 0.7~1.43; and in the P magnetic legs in each column, a proportional value E between lengths of line segments of the $(n+1)^{th}$ third cross line segment at two sides of the second symmetric plane is 0.7~1.43, and a proportional value F between lengths of line segments of the $(n+1)^{th}$ fourth cross line segment at two sides of the first symmetric plane is 0.7~1.43.

According to an example embodiment of the present disclosure, in the Q magnetic legs in each row, each of the (2n+1) first cross line segments has the same length, and each of the (2n+1) second cross line segments has the same length; and in the P magnetic legs in each column, each of the (2n+1) third cross line segments has the same length, and each of the (2n+1) fourth cross line segments has the same length. The design of the same length of each cross line segment is easy for manufacturing and implementation, and the cross line segment are entirely symmetrically distributed at two sides of the symmetric plane, accordingly the magentomotive force (MMF) is more uniform between the two adjacent magnetic legs, thereby a smaller AC loss coefficient Kac is obtained, According to an example embodiment of the present disclosure, in the Q magnetic legs in each row, a length of the $(n+1)^{th}$ cross line segment is greater than or equal to a length of any of other 2n cross line segments, a length of at least one cross line segment of said other 2n cross line segments is less than the length of the $(n+1)^{th}$ cross line segment among the (2n+1) first cross line segments; a length of the $(n+1)^{th}$ cross line segment is greater than or equal to a length of any of other 2n cross line segments, and a length of at least one cross line segment of said other 2n cross line segments is less than the length of the $(n+1)^{th}$ cross line segment among the (2n+1) second cross line segments; and in the P magnetic legs in each column, a length of the $(n+1)^{th}$ cross line segment is greater than or equal to a length of any of other 2n cross line segments, a length of at least one cross line segment of said other 2n cross line segments is less than the length of the $(n+1)^{th}$ cross line segment among the (2n+1) third cross line segments; a length of the $(n+1)^{th}$ cross line segment is greater than or equal to a length of any of other 2n cross line segments, and a length of at least one cross line segment of said other 2n cross line segments is less than the length of the $(n+1)^{th}$ cross line segment among the (2n+1) fourth cross line segments.

According to an example embodiment of the present disclosure, in the Q magnetic legs in each row, lengths of the (2n+1) first cross line segments gradually increase from the first line segment to the $(n+1)^{th}$ cross line segment, and gradually decrease from the $(n+1)^{th}$ line segment to the $(2n+1)^{th}$ line segment; lengths of the (2n+1) second cross line segments gradually increase from the first line segment to the $(n+1)^{th}$ line segment, and gradually decrease from the $(n+1)^{th}$ line segment to the $(2n+1)^{th}$ line segment; and in the P magnetic legs in each column, lengths of the (2n+1) third cross line segments gradually increase from the first line segment to the $(n+1)^{th}$ line segment, and gradually decrease from the $(n+1)^{th}$ line segment to the $(2n+1)^{th}$ line segment; and lengths of the (2n+1) fourth cross line segments gradually increase from the first line segment to the $(n+1)^{th}$ line segment, and gradually decrease in sequence from the $(n+1)^{th}$ line segment to the $(2n+1)^{th}$ line segment.

Taking the magnetic unit with 2×2 matrix magnetic legs as shown in FIGS. 10A-10B as an example, of which n=1, that is, there are three cross line segments—the 1st to the 3rd cross line segment in sequence—between any two magnetic legs. The three cross line segments may be designed as unequal lengths, for example, making the length of the 2nd cross line segment longer than the length of the 1st cross line segment while the length of the 2nd cross line segment longer than the length of the 3rd cross line segment, as a result, a lower the DC resistance Rdc can be obtained.

According to an example embodiment of the present disclosure, the first winding and the second winding are used as a primary winding and a secondary winding of the transformer, respectively.

According to an example embodiment of the present disclosure, the magnetic unit includes a plurality of the first winding wound around the P*Q magnetic legs. Similarly, as the example embodiment as shown in FIGS. 8A-8B, the windings are expanded in the her of layers (i.e., added in the direction of z), and also used for increasing the area of copper and decreasing the DC resistance Rdc.

According to an example embodiment of the present disclosure, an angle between any row and any column of magnetic matrix is 80~90°. That is, any row and any column are not limited to be perpendicular to each other.

Through the detailed descriptions above, it is easy to understand for those skilled in the art that a magnetic unit or a magnetic component according to the embodiments of the present disclosure has one or more advantages as follows.

According to some embodiments of the present disclosure, the part of the coils of the first winding between any two adjacent magnetic legs are generally symmetrically disposed at both sides of the symmetric plane between the two adjacent magnetic legs, as a result, the distribution of the magnetomotive force (MMF) is uniform between any two adjacent magnetic legs. Therefore, the magnetic unit of the present disclosure has a very low AC loss as well as a very high utilization of copper (which means having a very small DC resistance Rdc), accordingly the total loss of the magnetic unit is very low.

According to some embodiments of the present disclosure, by adding more magnetic legs for matrix expansion, larger areas and larger proportion of areas where the distribution of the magnetomotive force (MMF) is uniform can be obtained.

According to some other embodiments of the present disclosure, the length of the $(n+1)^{th}$ cross line segment among the (2n+1) cross line segments of the first winding section or the second winding section between the $i^{th}$ magnetic leg and the $(i+1)^{th}$ magnetic leg is greater than or equal to a length of any one of other 2n cross line segments, thus a lower DC resistance Rdc value can be obtained.

Other embodiments of the present disclosure will be apparent to those skilled in the art after they refer to the specification and practice the present disclosure. It is intended that the present disclosure covers any variations, applications, or adaptations of the present disclosure, which are in accordance with the general principles of the present disclosure and include common general knowledge or conventional technical means in the art that are not disclosed in the present disclosure. The specification and embodiments are be regarded as illustrative only, and the true scope and spirit of the disclosure is pointed out by the following claims.

It should be understood that the scope of the present disclosure is not limited to the exact structure described above and shown in the drawings, and can be made various modifications or altered without departing from the scope of the present disclosure. The scope of the present disclosure is only limited by the attached claims.

What is claimed is:

1. A magnetic unit, comprising:

a magnetic core, comprising: Q magnetic legs arranged in a row, wherein Q is a natural number and Q≥2;

a first winding wound around the Q magnetic legs; and a second winding magnetically coupled with the first winding and wound around the Q magnetic legs;

wherein the first winding comprises a first winding section formed on a first layer and a second winding section formed on a second layer;

wherein a virtual straight line exists between an $i^{th}$ magnetic leg and an $(i+1)^{th}$ magnetic leg adjacent to the $i^{th}$ magnetic leg among the Q magnetic legs, the virtual straight line intersects with a projection of the first winding section to form first cross line segments, and the number of the first cross line segments is (2n+1), and the virtual straight line intersects with a projection of the second winding section to form second cross line segments, and the number of the second cross line segments is (2n+1), wherein $1 \le i \le Q-1$ and $n \ge 1$;

wherein the $i^{th}$ magnetic leg and the $(j+1)^{th}$ magnetic leg have a symmetric plane, and a $(n+1)^{th}$ cross line segment among the (2n+1) first cross line segments intersects with the symmetric plane; and a $(n+1)^{th}$ cross line segment among the (2n+1) second cross line segments intersects with the symmetric plane.

2. The magnetic unit according to claim 1, wherein an innermost turn of the first winding section wound around the $i^{th}$ magnetic leg and an innermost turn of the second winding section wound around the $i^{th}$ magnetic leg are connected in series, and an innermost turn of the first winding section wound around the $(i+1)^{th}$ magnetic leg and an innermost turn of the second winding section wound around the $(i+1)^{th}$ magnetic leg are connected in series.

3. The magnetic unit according to claim 1, wherein a proportional value A between lengths of the $(n+1)^{th}$ cross line segment among the (2n+1) first cross line segments at two sides of the symmetric plane is 0.7~1.43; and a proportional value B between lengths of the $(n+1)^{th}$ cross line segment among the (2n+1) second cross line segments at two sides of the symmetric plane is 0.7~1.43.

4. The magnetic unit according to claim 1, wherein each of the (2n+1) first cross line segments has the same length.

5. The magnetic unit according to claim 1, wherein among the (2n+1) first cross line segments, a length of the $(n+1)^{th}$ cross line segment is greater than or equal to a length of any of other 2n cross line segments, and a length of at least one cross line segment of said other 2n cross line segments is less than the length of the $(n+1)^{th}$ cross line segment; and among the (2n+1) second cross line segments, a length of the $(n+1)^{th}$ cross line segment is greater than or equal to a length of any of other 2n cross line segments, and a length of at least one cross line segment of said other 2n cross line segments is less than the length of the $(n+1)^{th}$ cross line segment.

6. The magnetic unit according to claim 1, wherein lengths of the (2n+1) first cross line segments gradually increase from the first line segment to the $(n+1)^{th}$ line segment, and gradually decrease from the $(n+1)^{th}$ line segment to the $(2n+1)^{th}$ line segment; and lengths of the (2n+1) second cross line segments gradually increase from the first line segment to the $(n+1)^{th}$ line segment, and gradually decrease from the $(n+1)^{th}$ line segment to the $(2n+1)^{th}$ line segment.

7. The magnetic unit according to claim 1, wherein the first winding or the second winding is formed by a PCB, a copper foil, a pie winding or any combination thereof.

8. The magnetic unit according to claim 1, wherein the first winding and the second winding are used as a primary winding and a secondary winding of the transformer, respectively.

9. The magnetic unit according to claim 1, further comprising a plurality of the first windings wound around the Q magnetic legs.

10. A magnetic unit, comprising:

a magnetic core, comprising a magnetic matrix having magnetic legs arranged with P rows and Q columns, where P and Q are natural numbers and P≥2, Q≥2;

a first winding wound around the P*Q magnetic legs; and a second winding magnetically coupled with the first winding and wound around the P*Q magnetic legs;

wherein the first winding comprises a first winding section formed on a first layer and a second winding section formed on a second layer;

wherein a first virtual straight line exists between an $i^{th}$ magnetic leg and an $(i+1)^{th}$ magnetic leg adjacent to the $i^{th}$ magnetic leg among the Q magnetic legs in each row, the first virtual straight line intersects with a projection of the first winding section to form first cross line segments, and the number of the first cross line segments is (2+1), and the first virtual straight line intersects with a projection of the second winding section to form second cross line segments, and the number of the second cross line segments is (2n+1), wherein a second virtual straight line exists between a $j^{th}$ magnetic leg and a $(j+1)^{th}$ magnetic leg adjacent to the $j^{th}$ magnetic leg among the P magnetic legs in each column, the second virtual straight line intersects with a projection of the first winding section to form third cross line segments, and the number of the third cross line segments is (2n+1), and the second virtual straight line intersects with a projection of the second winding section to form fourth cross line segments, and the number of the fourth cross line segments is (2n+1), wherein $1 \le i \le Q-1$, $1 \le j \le P-1$ and $n \ge 1$;

wherein the magnetic leg and the $(i+1)^{th}$ magnetic leg adjacent to the magnetic leg in each row have a first symmetric plane, and a $(n+1)^{th}$ cross line segment among the (2n+1) first cross line segments intersects with the first symmetric plane; a $(n+1)^{th}$ cross line segment among the (2n+1) second cross line segments intersects with the first symmetric plane; the $j^{th}$ magnetic leg and the $(j+1)^{th}$ magnetic leg adjacent to the $j^{th}$ magnetic leg in each column have a second symmetric plane, and a $(n+1)^{th}$ cross line segment among the (2n+1) third cross line segments intersects with the second symmetric plane; and a $(n+1)^{th}$ cross line segment among the (2n+1) fourth cross line segments intersects with the second symmetric plane.

11. The magnetic unit according to claim 10, wherein in the Q magnetic legs in each row, an innermost turn of the first winding section wound around the $i^{th}$ magnetic leg and an innermost turn of the second winding section wound around the $i^{th}$ magnetic leg are connected in series, and an innermost turn of the first winding section wound around the $(i+1)^{th}$ magnetic leg of the Q magnetic legs and an innermost turn of the second winding section wound around the $(i+1)^{th}$ magnetic leg are connected in series; and in the P magnetic legs in each column, an innermost turn of the first winding section wound around the $j^{th}$ magnetic leg and an innermost turn of the second winding section wound around the $j^{th}$ magnetic leg are connected in series, and an innermost turn of the first winding section wound around the $(j+1)^{th}$ magnetic leg and an innermost turn of the second winding section wound around the $(j+1)^{th}$ magnetic leg are connected in series.

12. The magnetic unit according to claim 10, wherein in the Q magnetic legs in each row, a proportional value C between lengths of the $(n+1)^{th}$ cross line segment among the (2n+1) first cross line segments at two sides of the first symmetric plane is 0.7~1.43, and a proportional value D between lengths of the $(n+1)^{th}$ cross line segment among the (2n+1) second cross line segments at two sides of the first symmetric plane is 0.7~1.43; and in the P magnetic legs in each column, a proportional value E between lengths of the $(n+1)^{th}$ cross line segment among the (2n+1) third cross line segments at two sides of the second symmetric plane is 0.7~1.43, and a proportional value F between lengths of the $(n+1)^{th}$ cross line segment among the (2n+1) fourth cross line segments at two sides of the first symmetric plane is 0.7~1.43.

13. The magnetic unit according to claim 10, wherein in the Q magnetic legs in each row, each of the (2n+1) first cross line segments has the same length, and each of the (2n+1) second cross line segments has the same length; and in the P magnetic legs in each column, each of the (2n+1) third cross line segments has the same length, and each of the (2n+1) fourth cross line segments has the same length.

14. The magnetic unit according to claim 10, wherein in the Q magnetic legs in each row, a length of the $(n+1)^{th}$ cross line segment is greater than or equal to a length of any of other 2n cross line segments, a length of at least one cross line segment of said other 2n cross line segments is less than the length of the $(n+1)^{th}$ cross line segment among the (2n+1) first cross line segments; a length of the $(n+1)^{th}$ cross line segment is greater than or equal to a length of any of other 2n cross line segments, and a length of at least one cross line segment of said other 2n cross line segments is less than the length of the $(n+1)^{th}$ cross line segment among the (2n+1) second cross line segments; and in the P magnetic legs in each column, a length of the $(n+1)^{th}$ cross line segment is greater than or equal to a length of any of other 2n cross line segments, a length of at least one cross line segment of said other 2n cross line segments is less than the length of the $(n+1)^{th}$ cross line segment among the (2n+1) third cross line segments; a length of the $(n+1)^{th}$ cross line segment is greater than or equal to a length of any of other 2n cross line segments, and a length of at least one cross line segment of said other 2n cross line segments is less than the length of the $(n+1)^{th}$ cross line segment among the (2n+1) fourth cross line segments.

15. The magnetic unit according to claim 10, wherein in the Q magnetic legs in each row, lengths of the (2n+1) first cross line segments gradually increase from the first line segment to the $(n+1)^{th}$ line segment, and gradually decrease from the $(n+1)^{th}$ line segment to the $(2n+1)^{th}$ line segment; lengths of the (2n+1) second cross line segments gradually increase from the first line segment to the $(n+1)^{th}$ line segment, and gradually decrease from the $(n+1)^{th}$ line segment to the $(2n+1)^{th}$ line segment; and in the P magnetic legs in each column, lengths of the (2n+1) third cross line segments gradually increase from the first line segment to the $(n+1)^{th}$ line segment, and gradually decrease from the $(n+1)^{th}$ line segment to the $(2n+1)^{th}$ line segment; and lengths of the (2n+1) fourth cross line segments gradually increase from the first line segment to the $(n+1)^{th}$ line segment, and gradually decrease from the $(n+1)^{th}$ line segment to the $(2n+1)^{th}$ line segment.

16. The magnetic unit according to claim 10, wherein the first winding or the second winding is formed by a PCB, a copper foil, a pie winding or any combination thereof.

17. The magnetic unit according to claim 10, wherein the first winding and the second winding are used as a primary winding and a secondary winding of the transformer, respectively.

18. The magnetic unit according to claim 10, further comprising a plurality of the first windings wound around the P*Q magnetic legs.

19. The magnetic unit according to claim 10, wherein an angle between any row and any column of the magnetic matrix is 80°~90°.

* * * * *